United States Patent [19]

Smith

[11] 4,220,323

[45] Sep. 2, 1980

[54] SHEET RECEIVING AND STACKING APPARATUS

[75] Inventor: John E. Smith, Hilton, N.Y.

[73] Assignee: Eastman Kodak Company, Rochester, N.Y.

[21] Appl. No.: 64,924

[22] Filed: Aug. 8, 1979

[51] Int. Cl.[3] ..... B65H 29/58; B65H 31/00

[52] U.S. Cl. ..... 271/65; 271/186; 271/207; 271/213

[58] Field of Search ..... 271/65, 66, 184, 186, 271/207, 213

[56] References Cited

U.S. PATENT DOCUMENTS

| | | | |
|---|---|---|---|
| 3,154,356 | 10/1964 | Lewis et al. | 271/207 |
| 3,243,181 | 3/1966 | Lyman . | |
| 3,292,923 | 12/1966 | Fairbanks et al. | 271/65 X |
| 3,421,798 | 1/1969 | Albright . | |
| 3,617,053 | 11/1971 | Menard | 271/207 X |
| 3,700,231 | 10/1972 | Aasen | 271/65 X |
| 3,912,389 | 10/1975 | Miyamoto | 271/213 X |
| 3,997,263 | 12/1976 | Stemmle | 355/24 |
| 4,033,694 | 7/1977 | Ferrari | 355/76 |
| 4,040,616 | 8/1977 | Clarkson | 271/65 |
| 4,054,285 | 10/1977 | Stange et al. | 271/186 |

OTHER PUBLICATIONS

Xerox Disclosure Journal, vol. 4, No. 3; P. 317; "Copy Inverting Tray" Armando Fernandez May/Jun. 1979.

*Primary Examiner*—Robert W. Saifer
*Attorney, Agent, or Firm*—Lawrence P. Kessler

[57] ABSTRACT

Apparatus for selectively stacking, or inverting and stacking, sheets moving seriatim along a travel path with a given facial orientation. The apparatus comprises a sheet supporting surface for supporting and stacking sheets in a facial orientation effectively reversed from that of such sheets in the travel path, and a guide selectively movable to a first position along the travel path or a second position in the travel path. In the first position, the guide directs sheets onto the supporting surface; while in the second position the guide itself receives and stacks the sheets, remote from the supporting surface, in a facial orientation the same as that of such sheets in the travel path.

11 Claims, 4 Drawing Figures

SHEET RECEIVING AND STACKING APPARATUS

BACKGROUND OF THE INVENTION

This invention relates to apparatus for receiving and stacking sheets, and more particularly to an apparatus which stacks sheets in page sequential order, irrespective of whether the sheets are fed to the apparatus seriatim first-sheet-first or last-sheet-first.

In certain types of available reproduction devices, such as high-speed printers or copiers, original multipage documents may be reproduced in page sequential order (first-page-first) or in inverse page sequential order (last-page-first). The original document pages are delivered seriatim to a copying station of the reproduction devices either manually or via an automatic document positioner such as described in U.S. Pat. No. 4,033,694, issued July 5, 1977 in the name of Ferrari. After the desired number of reproduction copies are made on receiver sheets, the copies are delivered to a receiving and stacking apparatus. Depending upon the particular reproduction device used, the copies may be delivered image face-down or -up. When the document pages are delivered to the copy station in page sequential order, the copies are delivered to the stacking apparatus in the same order. If the copies are delivered to the stacking apparatus image face-down and are stacked in the apparatus one on top of the other, the complete copied document is also in page sequential order. However, when the document pages are delivered to the copy station in inverse page sequential order and the copies delivered to the stacking apparatus image face down, the copies would be stacked in the apparatus in such inverse page sequential order unless they are inverted prior to being received in the apparatus. On the other hand, if the exiting copies are image face-up, they would be in page sequential order when the original document pages are copied in inverse page sequential order and in inverse page sequential order (unless inverted) when the document pages are copied in page sequential order.

It is, of course, desirable to have the complete copied document in page sequential order. To insure such page sequential order stacking of the copies of an original multipage document, fed either in page sequential order or inverse page sequential order, reproduction devices have been provided with alternate sheet paths to separate stacking and receiving apparatus. See for example, U.S. Pat. No. 3,700,231 issued Oct. 24, 1972, in the name of Aasen et al. However, the use of alternate paths and separate stacking apparatus necessitates duplication of structural components and results in complexities of the sheet travel path which may cause delivery problems, such as jams.

SUMMARY OF THE INVENTION

This invention is directed to apparatus for selectively stacking, or inverting and stacking, sheets moving seriatim along a travel path with a given facial orientation. The apparatus comprises a sheet supporting surface for supporting and stacking sheets in a facial orientation effectively reversed from that of such sheets in the travel path, and a guide selectively movable to a first position along the travel path or a second position in the travel path. In the first position, the guide directs sheets onto the supporting surface; while in the second position the guide itself receives and stacks the sheets, remote from the supporting surface, in a facial orientation the same as that of such sheets in the travel path.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
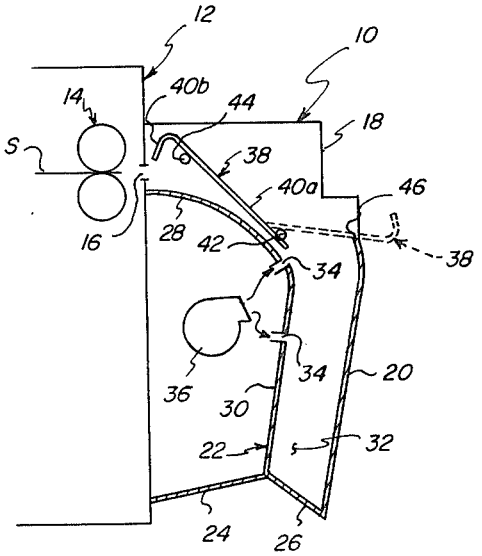
FIG. 1 is a side elevational view, in cross-section, of the sheet receiving and stacking apparatus according to this invention, associated with a sheet handling device.
Figure 2:
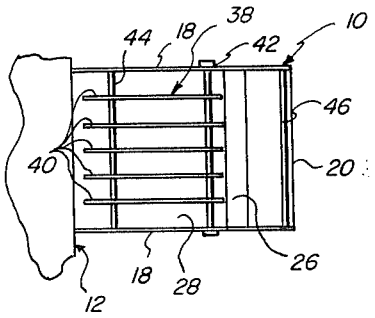
FIG. 2 is a top plan view of the apparatus of FIG. 1.

Referring now to the drawings, the sheet receiving and stacking apparatus 10 is connected, for example, to a sheet handling device such as an electrophotographic copier 12 (see FIGS. 1 and 2). The copier 12 reproduces original document pages on receiver sheets (e.g. sheet S), the document pages being reproduced in page sequential order (first-page-first) or inverse page sequential order (last-page-first). The reproductions may be made on the top of a sheet (image face-up) or the bottom of a sheet (image face-down). A pair of feed rollers 14 feed reproduction-bearing receiver sheets through an opening 16 along a path P into the apparatus 10 at a velocity sufficient to propel the sheet substantially across the apparatus.

The apparatus 10 includes a pair of side walls 18 interconnected by sloped end wall 20, an intermediate wall 22, and bottom walls 24, 26. The intermediate wall 22 has an upper sloped portion 28 and a lower portion 30 substantially parallel to wall 20. The portion 28 serves as a lower guide surface for receiver sheets exiting through opening 16; while portion 30, in cooperation with side walls 18, end wall 20 and bottom wall 26 comprise a reception hopper 32. Additionally, the intermediate wall 22 has a plurality of ports 34 in flow communication with a positive air source 36, such as an air pump. Air pressure from the source 36 urges sheets received in the hopper 32 against the end wall 20.

The apparatus 10 also includes a guide 38 having a plurality of generally "J" shaped wire-form members 40. The members 40 have a straight portion **40*a*, connected to a pivot pin 42 (carried by the side walls 18), and a curved end portion 40*b*. A stop member 44, carried by the side walls 18, locates the guide 38 in a first position (solid line position in FIG. 1). In this first position, the straight portions 40*a* of the respective members 40 intercept the sheets exiting from opening 16 for directing and guiding the sheets into the hopper 32. The top edge 46 of the end wall 20 serves as a second stop for locating the guide in a second position (broken line position of FIG. 1). In this second position, the straight portions 40*a* lie in the travel path P so that the sheets may be received and stacked on the guide 38**.

Figure 3:
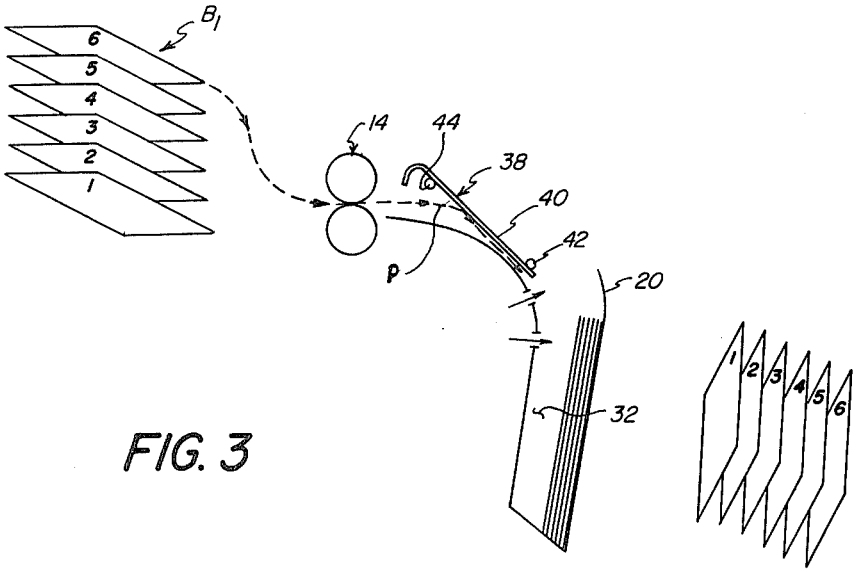
FIG. 3 is a schematic illustration of the apparatus of this invention in position to receive and stack sheets fed last-sheet-first, image face-down.

The two positions of the guide 38 enable the apparatus 10 to be used to stack the receiver sheets in a preselected order (e.g., page sequential order) irrespective of the order in which the sheets are delivered from the copier 12 to the apparatus (i.e., first-page-first or last-page-first) or the facial orientation of the sheets in the travel path (i.e., image face-up or -down). By way of illustrative example, FIG. 3 shows a booklet $B_1$ of receiver sheets produced in the copier 12 image face-down, and fed from the copier last-page-first. To stack such sheets in page sequential order, the guide 38 is located against stop 44. The receiver sheets exiting seriatim from the copier along the path P are intercepted by the wire-form members 40 and guided into the hopper 32. Air pressure from the source 36 urges the sheets against the end wall 20 where, because of the slope of the wall, they are effectively inverted (image face-up) with respect to their orientation upon exiting from the copier. Accordingly, the sheets are stacked in page sequential order with the last page being on the bottom of the stack and having its image face-up, the next-to-last page being on the last page and having its image face-up, etc.

Figure 4:
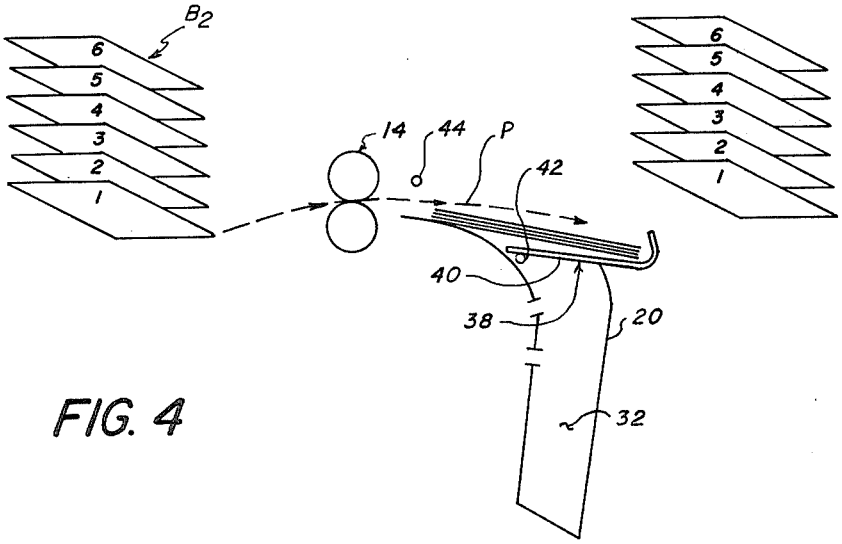
FIG. 4 is a schematic illustration of the apparatus of this invention in position to receive and stack sheets fed first-sheet-first, image face-down.

In FIG. 4, a booklet $B_2$ is shown which is produced by the copier 12 image face-down, and fed therefrom first-page-first. In this instance, the guide 38 is located in its second position against the edge 46 of the end wall 20. The velocity of the exiting sheets carries them above the guide 38 where they settle by gravitational force onto the wire-form members 40. The curved end portions **40*b*** of the members hold the sheets on the members. Accordingly, the stacked sheets are in page sequential order with the first page being on the bottom of the stack and having its image face-down, the second page being on the first page and having its image face-down, etc.

Of course, the apparatus 10 can also serve to stack receiver sheets in the preselected order when reproduced image face-up, and fed first-page-first by locating the guide 38 in its first position, or when reproduced image face-up, and fed last-page-first by locating the guide 38 in its second position. Further, the apparatus fascilitates stacking when reproducing images on both sides of the receiver sheets (duplex copying). For example, if the copier 12 reproduces images on the bottom of the receiver sheets, the odd number pages (e.g., 1, 3, 5, etc.) are reproduced first, in order, and stacked in the mechanism 10 on the guide 38 in its second position. The stack is thus in the same order with the images face-down. The stack is turned over and returned to the copier where the even number pages (e.g., 2, 4, 6, etc.) are reproduced on the opposite side of the sheets. With the guide 38 in its first position, the sheets copied on both sides are stacked in the bin 32, in order, with the first sheet, page 1, image face-down on the bottom (page 2, image face-up); the second sheet, page 3, image face-down next; etc. Additionally, while the mechanism 10 has been described as for stacking receiver sheets, it could also be used for restacking automatically fed original document pages in a preselected order.

This invention has been described in detail with particular reference to a preferred embodiment thereof, but it will be understood that variations and modifications can be effected within the spirit and scope of the invention.

I claim:

1. Apparatus for selectively stacking, or inverting and stacking, sheets moving seriatim along a travel path with a given facial orientation, said apparatus comprising:

means defining a sheet supporting surface for supporting and stacking sheets in a facial orientation effectively reversed from that of such sheets in the travel path; and means selectively movable (i) to a first position along the travel path for guiding the sheets onto said supporting surface or (ii) to a second position in the travel path for itself receiving and stacking the sheets, remote from said supporting surface, in a facial orientation the same as that of such sheets in the travel path.

2. The invention of claim 1 wherein said movable means comprises: a guide, and means for pivotally supporting said guide relative to the travel path for movement to said first position or said second position.

3. The invention of claim 1 wherein said apparatus further includes means for urging sheets guided by said movable means onto said sheet supporting toward said supporting surface.

4. For use with a copier for feeding receiver sheets of a sequentially ordered multipage document seriatim along a travel path, with a given facial orientation, in a first sequential order or in a second sequential order, apparatus for stacking such sheets from said path so that the sheets are stacked in a preselected sequential order irrespective of the given facial orientation or the order in which they are fed, said apparatus comprising:

a bin having at least one wall for supporting sheets delivered thereto in stacked relationship in a facial orientation effectively reversed from that of such sheets in the travel path; and means, selectively movable (i) to a first position along the travel path for guiding sheets fed seriatim in said first order toward said wall to be stacked in said preselected order, or (ii) to a second position in the travel path for itself receiving and stacking sheets fed seriatim in said second order in said preselected sequential order in a facial orientation the same as that of such sheets in the travel path.

5. The invention of claim 4 wherein said movable means comprises: a guide, and means for pivotally supporting said guide relative to the travel path for movement to said first position or said second position.

6. The invention of claim 5 wherein said guide comprises a series of wire-form members, said members being of generally "J" shaped configuration.

7. The invention of claim 6 wherein when said guide is in said first position, the straight portions of said wire-form members guide sheets in the travel path; and when said guide is in said second position, the sheet are received and stacked on the straight portions of said wire-form members.

8. The invention of claim 4 wherein said wall of said bin is positioned at an angle with respect to said travel path so as to invert such sheets, guided toward said wall by said movable means, with respect to the facial orientation of such sheets in the travel path.

9. The invention of claim 4 wherein said wall of said bin is inclined with respect to vertical, whereby sheets guided toward said wall by said movable means are supported on said wall with the surface of such sheets, which face upwardly in the travel path, facing downwardly when supported on said wall.

10. The invention of claim 9 wherein said bin includes means for urging sheets delivered to said bin toward said wall.

11. The invention of claim 10 wherein said urging means includes a source of pressurized air, and means for directing a flow of pressurized air from said source toward said wall.

* * * * *